US007415802B2

(12) United States Patent
Froeter et al.

(10) Patent No.: US 7,415,802 B2
(45) **Date of Patent: *Aug. 26, 2008**

(54) BI-FUNCTIONAL ROOF DRAIN HAVING INTEGRATED VENT

(75) Inventors: Craig J. Froeter, Sterling, IL (US); Jeff Giordano, Moline, IL (US)

(73) Assignee: Froet Industries, LLC, Sterling, IL (US)

( * ) Notice: Subject to any disclaimer, the term of this patent is extended or adjusted under 35 U.S.C. 154(b) by 434 days.

This patent is subject to a terminal disclaimer.

(21) Appl. No.: 11/202,766

(22) Filed: Aug. 12, 2005

(65) Prior Publication Data

US 2006/0059813 A1 Mar. 23, 2006

Related U.S. Application Data

(60) Provisional application No. 60/601,499, filed on Aug. 13, 2004.

(51) Int. Cl.
*E04D 13/04* (2006.01)

(52) U.S. Cl. ..... 52/302.1; 284/42; 210/163

(58) Field of Classification Search ..... 52/302.1, 52/302.7; 4/650, 652, 679; 210/163; 285/42; 137/357

See application file for complete search history.

(56) References Cited

U.S. PATENT DOCUMENTS 1,538,924 A * 5/1925 Boosey ..... 210/163
1,761,257 A * 6/1930 Fleming ..... 210/166
2,666,493 A * 1/1954 Gordon ..... 210/166
4,799,713 A * 1/1989 Uglow ..... 285/42
5,234,582 A * 8/1993 Savoie ..... 210/163
5,526,613 A * 6/1996 Simeone, Jr. ..... 52/12
5,966,884 A * 10/1999 Uglow ..... 52/302.1
6,594,966 B2 7/2003 Froeter

* cited by examiner

*Primary Examiner*—Richard E. Chilcot, Jr.
*Assistant Examiner*—Chi Q Nguyen
(74) *Attorney, Agent, or Firm*—Reinhert Boerner Van Deuren P.C.

(57) ABSTRACT

A bi-functional roof drain includes a housing forming a drain manifold and a drain outlet to connect to a drainage system. A vent pipe penetrates the housing and extends through the manifold. The top of the vent pipe is positioned a distance above the housing, which may be variable. With this drain, a method of retrofitting a roof drainage system to provide water drainage and system venting is also presented. This method includes removing an existing uni-functional roof drain from a deck penetration through the roof, and installing a bi-functional roof drain in the same deck penetration. The drain outlet is connected to the drainage system and the vent pipe is connected to the system that requires venting. The height of a top opening of the vent pipe of the bi-functional roof drain may be adjustable in relation to a surface of the roof.

20 Claims, 11 Drawing Sheets

BI-FUNCTIONAL ROOF DRAIN HAVING INTEGRATED VENT

CROSS-REFERENCE TO RELATED PATENT APPLICATIONS

This patent application claims the benefit of U.S. Provisional Patent Application No. 60/601,499 filed Aug. 13, 2004, the teachings and disclosure of which are incorporated in their entireties by reference thereto.

FIELD OF THE INVENTION

The present invention relates generally to building roof water drainage and ventilation systems, and more particularly to roof drains and ventilation systems for flat roofs.

BACKGROUND OF THE INVENTION

Commercial and industrial buildings are typically constructed with flat or near flat roofs. Because these buildings do not have much if any of a pitch to the roof, the collection of water on the roof surface resulting from rain and melting snow can present a serious structural load that could result in collapse of the roof's structure. To avoid this possibility most commercial and industrial building standards require that roofs of this type include drains positioned at locations that ensure that at least the majority of water accumulation may be removed from the roof through a drainage plumbing system. These commercial buildings also include various plumbing, heating, ventilation, etc. systems that require venting to the ambient air.

Typical roof drains and vent pipes are installed on flat roofs by cutting a hole through the roof deck and installing a drain therethrough and by cutting another hole through the roof deck and installing a vent pipe or conduit therethrough. The drain typically connects with drainage plumbing that carries the water away and the vent pipe typically connects to the system that requires external venting. The drain and vent structures typically include some form of flashing or collar that, through the application of sealant or other roof material, prevents leakage at the site of the drain installation and at the site of the vent installation. These typical drain and vent structures also include some form of drain ring and under deck clamping ring or structure that holds the drain or the vent in place and prevents its inadvertent removal or dislodgement from its installed position. The opening of the roof drain is typically covered by some form of grating or strainer structure to prevent the ingestion of large objects into the drain plumbing system. In most roof drain structures this strainer or grate takes the form of a hemispherical strainer to prevent or minimize the occurrence of obstruction of the roof drain through the accumulation of leaves and other debris that may accumulate on the roof. The opening of the roof vent may or may not include any grating, but typically does not.

While the usage of roof drains and vent pipes is required for the safety of the roof construction and the proper operation of various systems within the building, such also greatly increases the cost of the roof construction. This significant cost increase is a result of the requirement for the large number of holes through the roof to accommodate the roof drains and vent pipes that must be installed on the roof. Each roof drain and each vent pipe requires a separate deck penetration or hole to be cut in the roof structure. This substantially increases the labor cost associated with such a system as many roof penetrations must be cut. Further, depending on the number of roof drains and vent pipes that are installed, the overall structural strength of the roof may be weakened due to the large number of deck penetrations that are cut to accommodate both the roof drains and the vent pipes.

While these factors may be considered in the design of a new construction, and therefore compensated, the cost and structural impact of installing additional roof drains or additional vent pipes in existing buildings can be prohibitive. That is, on an existing building the roof's structure and strength are already set, and any impact thereto resulting from the installation of the roof drains or vent pipes is not easily compensated. Additionally, the roof surface itself may already be occupied by other equipment that limits the ability to properly position additional roof drains or vent pipes. Further, additional roof penetrations by other systems within a building may also limit the ability to install the roof drains or vent pipes at appropriate locations due to clearance requirements dictated by the roof penetrations of the other systems. As a result, the retrofit of an existing building to install additional roof drains or additional vent pipes often is not only expensive but also quite problematic if they can be installed at all.

BRIEF SUMMARY OF THE INVENTION

In view of the above, it is a general aim of the invention to provide a new and improved roof drain with an integrated vent for flat roofs. More particularly, it is a general aim of the present invention to provide a new and improved roof drain that provides both water drainage for flat roofs and ventilation for other building systems. Additionally, it is a general aim of the present invention to provide such a bi-functional roof drain for initial installations on new constructions, and for retrofitting existing structures to include the drainage and venting capability. Preferably, this retrofitting may be accomplished without the necessity of cutting additional roof deck penetrations.

In one embodiment of the present invention, a bi-functional roof drain comprises a drain housing having bottom and side walls forming a drain manifold. The drain housing further includes a drain outlet in communication with the drain manifold and is adapted to connect to a drainage system of a building. A strainer basket is positioned over an open top of the drain housing. Additionally, a vent pipe sealingly penetrates the drain housing and extends through the drain manifold and the strainer basket. This vent pipe has a top opening positioned a vertical distance above the open top of the drain housing. The vent pipe further includes a vent pipe outlet adapted to connect to a ventilation system or a system that requires ventilation in the building.

In a further embodiment the vent pipe penetrates the bottom wall, and the drain further comprises a gasket positioned in sealing arrangement between the bottom wall and the vent pipe. In one embodiment the vent pipe translatably extends through the drain manifold such that the vertical distance from the open top of the drain housing to the top opening of the vent pipe is variable. Preferably, the strainer basket includes clamping means positioned to securely retain the vent pipe at a given vertical position. In an alternate embodiment wherein the vent pipe translatably penetrates the bottom wall, the drain further comprises a gasket positioned in sealing arrangement between the bottom wall and the vent pipe. In yet a further embodiment, the vent pipe includes an extendable section within the drain manifold to accommodate variation of the vertical distance from the open top of the drain housing to the top opening of the vent pipe.

In one embodiment of the bi-functional roof drain, the drain housing and the vent pipe are formed as a unitary structure. In another embodiment the vent pipe includes a plurality of openings positioned in proximity to the top opening. Preferably, the bi-functional roof drain further comprises a weather head positioned over the top opening of the vent pipe. In one embodiment the drain outlet and the vent outlet are positioned to accommodate retrofitting of a uni-functional roof drain to provide drainage of accumulated water on a roof and to provide venting through a single roof penetration.

The present invention also embodies a method of retrofitting a roof drainage system to provide water drainage and venting. This method of retrofitting comprises the steps of removing an existing uni-functional roof drain from a deck penetration through the roof, and installing a bi-functional roof drain in the deck penetration. Preferably, the method further comprises the steps of installing a roof drainage and venting system, connecting a drain outlet of the bi-functional roof drain to the roof drainage system, and connecting a vent outlet of the bi-functional roof drain to the system requiring venting.

In an alternate embodiment of the method of the present invention, the method further comprises the step of adjusting a vertical height of a top opening of a vent pipe of the bi-functional roof drain in relation to a surface of the roof. Preferably, the step of adjusting includes the steps of determining the required height needed by the system requiring venting and setting the vertical height of the top opening of the vent pipe.

In yet a further alternate embodiment, a bi-functional roof drain is presented that comprises a drain housing forming a drain manifold therein having an open top, a drain outlet in communication with the drain manifold, and a vent pipe extending through and isolated from communication with the drain manifold. The vent pipe has a top opening positioned a vertical distance above the open top of the drain housing. The vent pipe further includes a vent outlet. Preferably, the bi-functional roof drain further comprises a strainer basket positioned over the open top. The drain pipe extends through the strainer basket. In one embodiment, the drain housing, the drain outlet and the vent pipe are formed as a unitary structure. Preferably, the unitary structure is molded. In yet an additional embodiment of the present invention, a distance between the top opening of the vent pipe and the open top of the drain housing is adjustable.

Other aims, advantages, and features of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
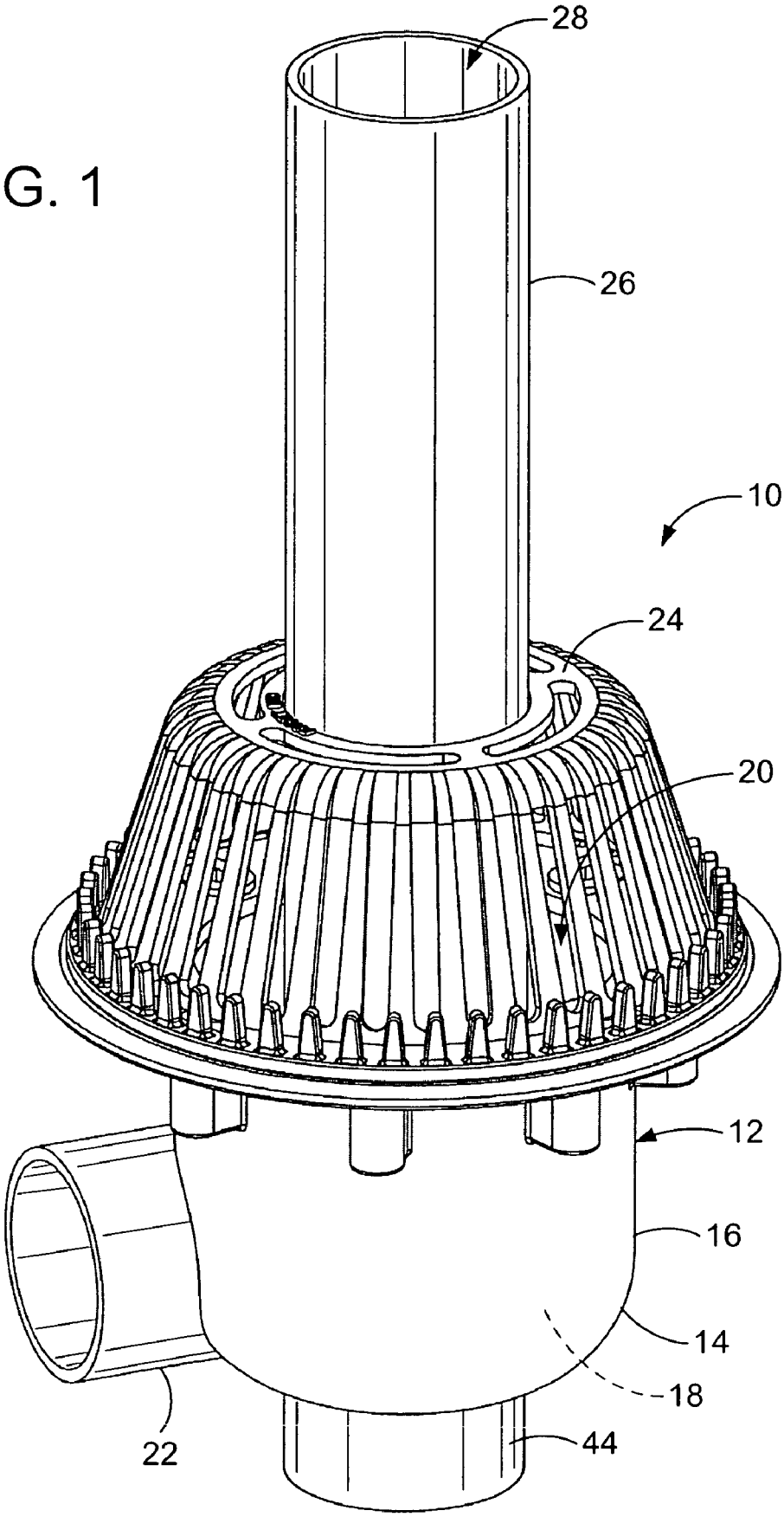
FIG. 1 is an isometric view of an embodiment of a bi-functional roof drain constructed in accordance with the teachings of the present invention.
Figure 2:
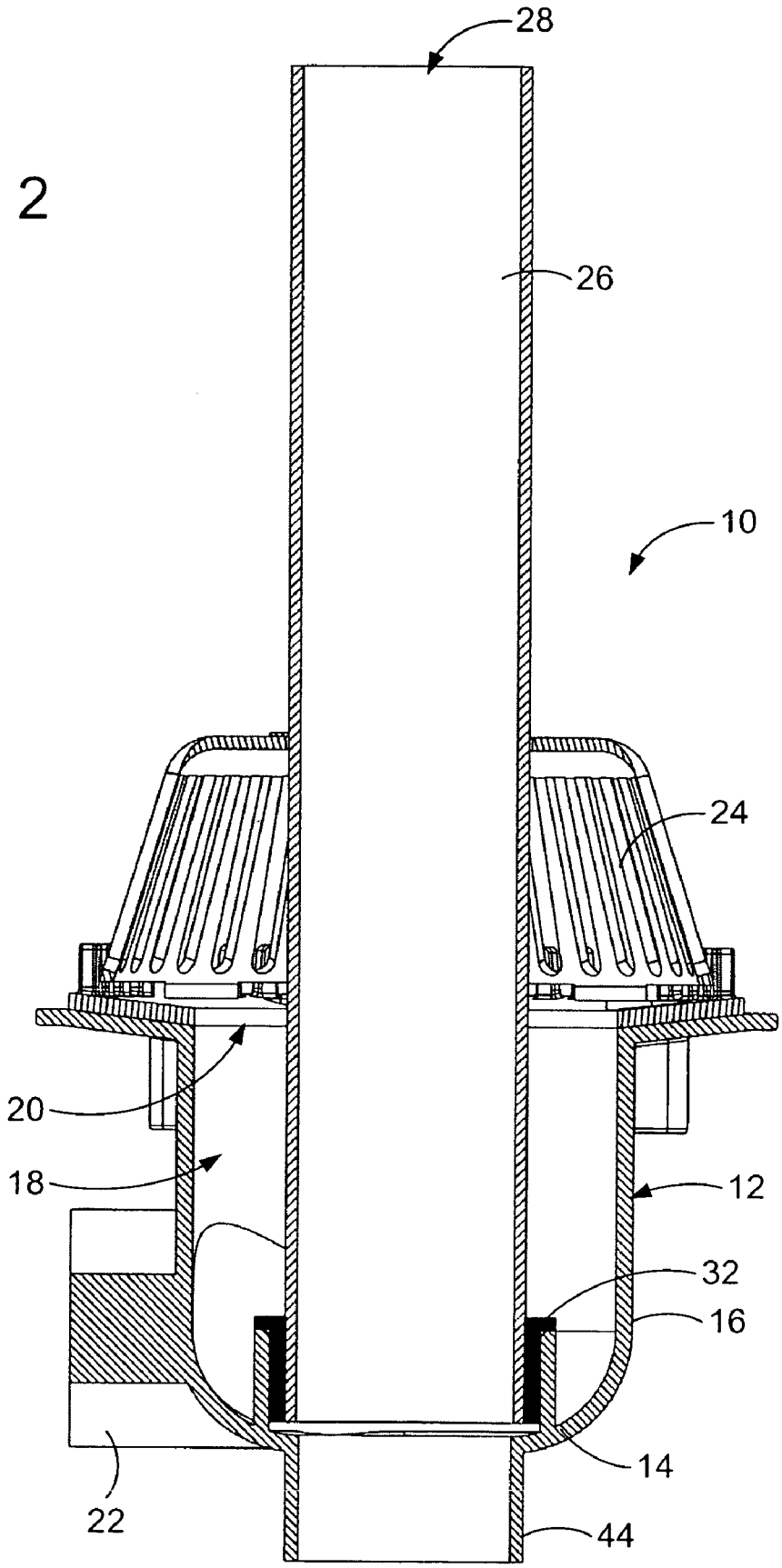
FIG. 2 is a cross section view of the bi-functional roof drain of FIG. 1.

Referring to FIGS. 1 and 2, the bi-functional roof drain 10 includes a drain housing 12 having a bottom 14 (i.e., bottom wall) and side walls 16. These walls 14, 16 form a drain manifold 18 (i.e., chamber) having an open top 20. An under deck clamping ring 21 (FIG. 6) with associated bolts 23 (FIG. 6) may be included, as is conventional, to secure the bi-functional roof drain 10 in its installed position on a roof in a known manner.

The drain housing 12 includes a drain outlet 22 in communication with the drain manifold 18. This drain outlet 22 is preferably adapted to connect to a drainage system of a building so that water that drains into the drain manifold 18 may be removed through drain outlet 22 to the main drainage system. To prevent the accumulation of debris within the drain manifold 10, the bi-functional roof drain may also include a strainer basket 24 positioned over the open top 20 of the drain housing 12. This strainer basket 24 may take various forms as are known in the art such that large debris is precluded from entering the drain manifold 18 but water may freely flow into the manifold without undue restriction. While the strainer may take various forms, it is preferred that the structure extend vertically from the plane of the open top 20 to minimize the possibility of simple obstruction by leaves or other debris that may more easily obstruct a flat grate.

Figure 3:
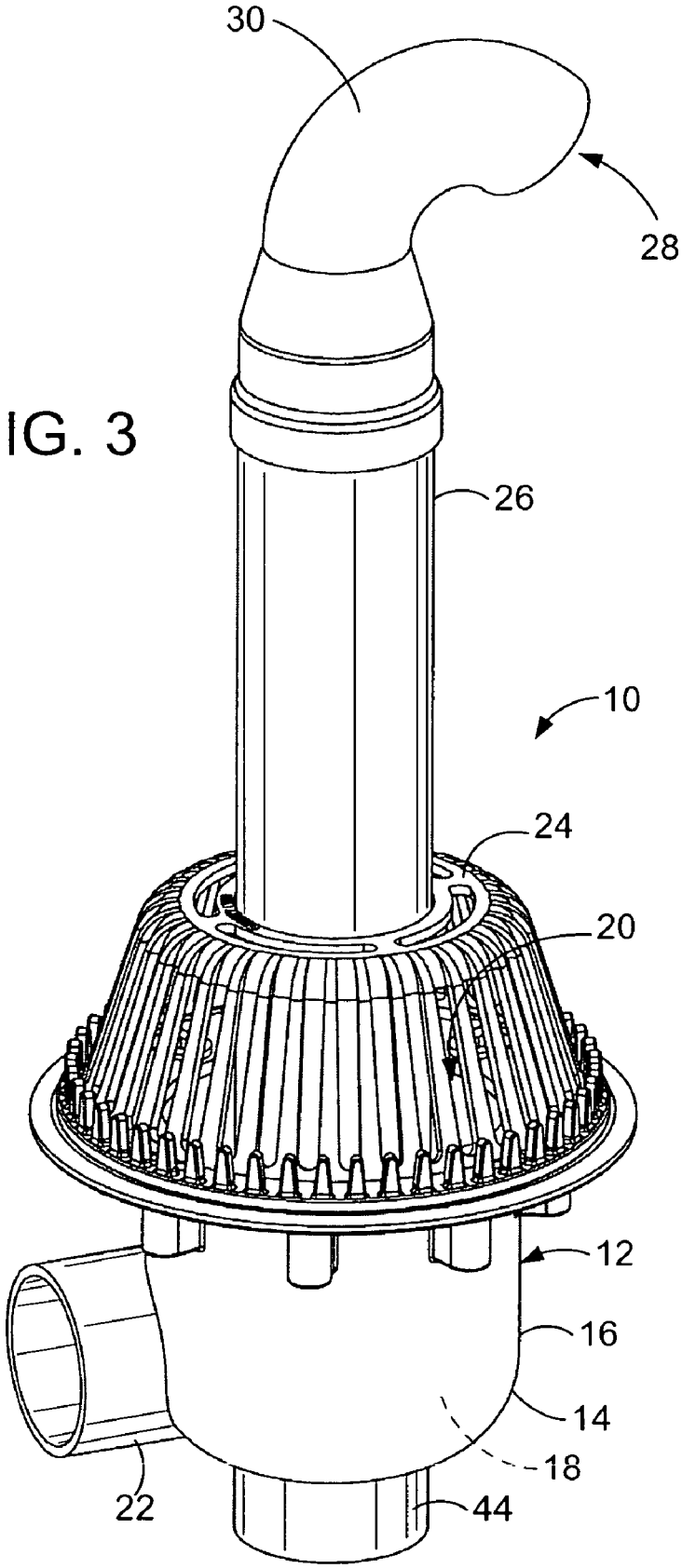
FIG. 3 is an isometric view of an alternate embodiment of the bi-functional roof drain constructed in accordance with the teachings of the present invention.
Figure 4:
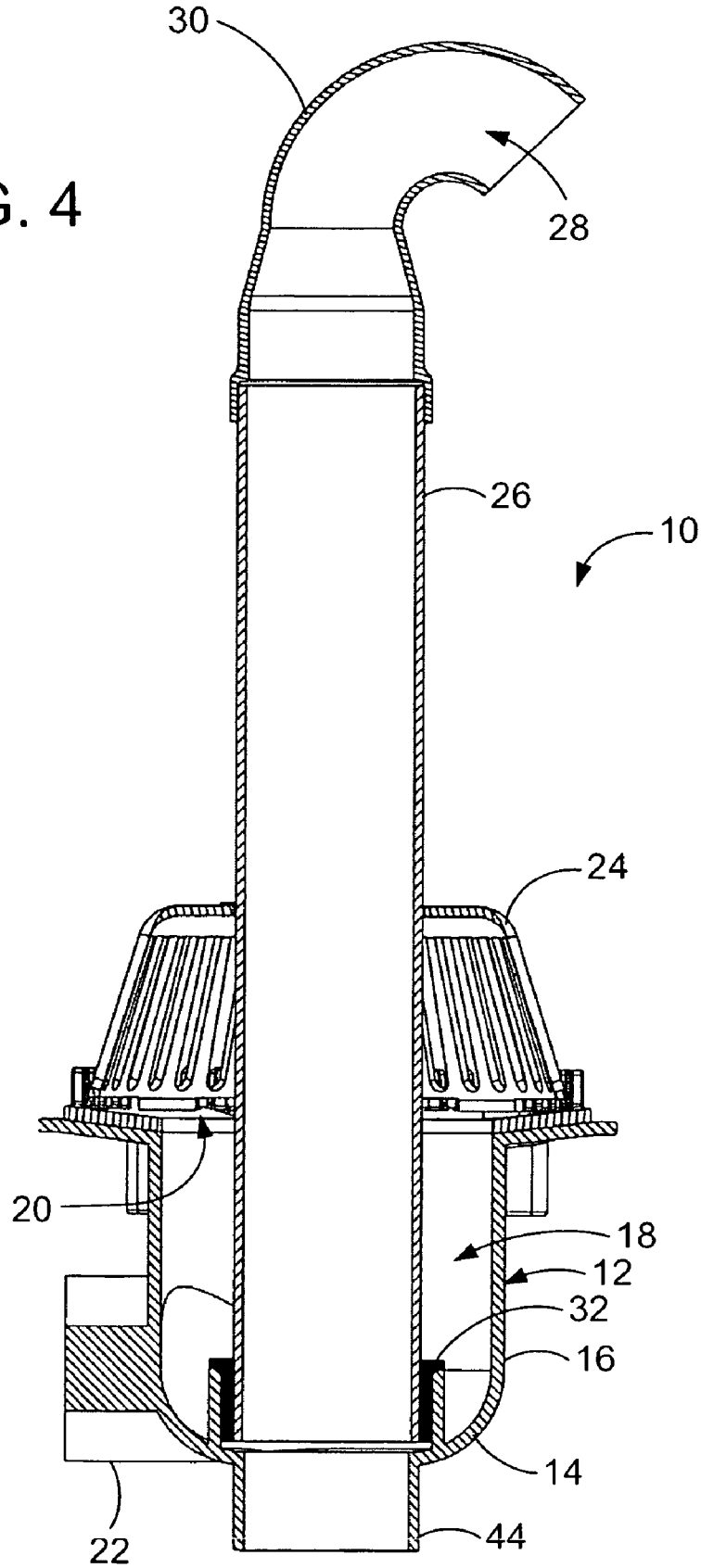
FIG. 4 is a cut-away side view of the alternate embodiment of the bi-functional roof drain illustrated in FIG. 3.

The bi-functional roof drain 10 also includes a vent pipe 26 that sealingly penetrates the drain housing 12 and extends through the drain manifold 18. The vent pipe 26 also extends through the strainer basket 24, although one skilled in the art will recognize that the geometry of strainer basket may be such to cover not only the open top 20 of the drain manifold 18 but also the vent pipe in one embodiment. The vent pipe 26 has a top opening 28 that is positioned a vertical distance above the open top 20 of the drain housing 12. As shown in FIGS. 3 and 4, this top opening 28 may be covered with an appropriate weather head 30 to prevent the ingestion of large debris that may block the vent system, although this weather head is entirely optional.

Figure 5:
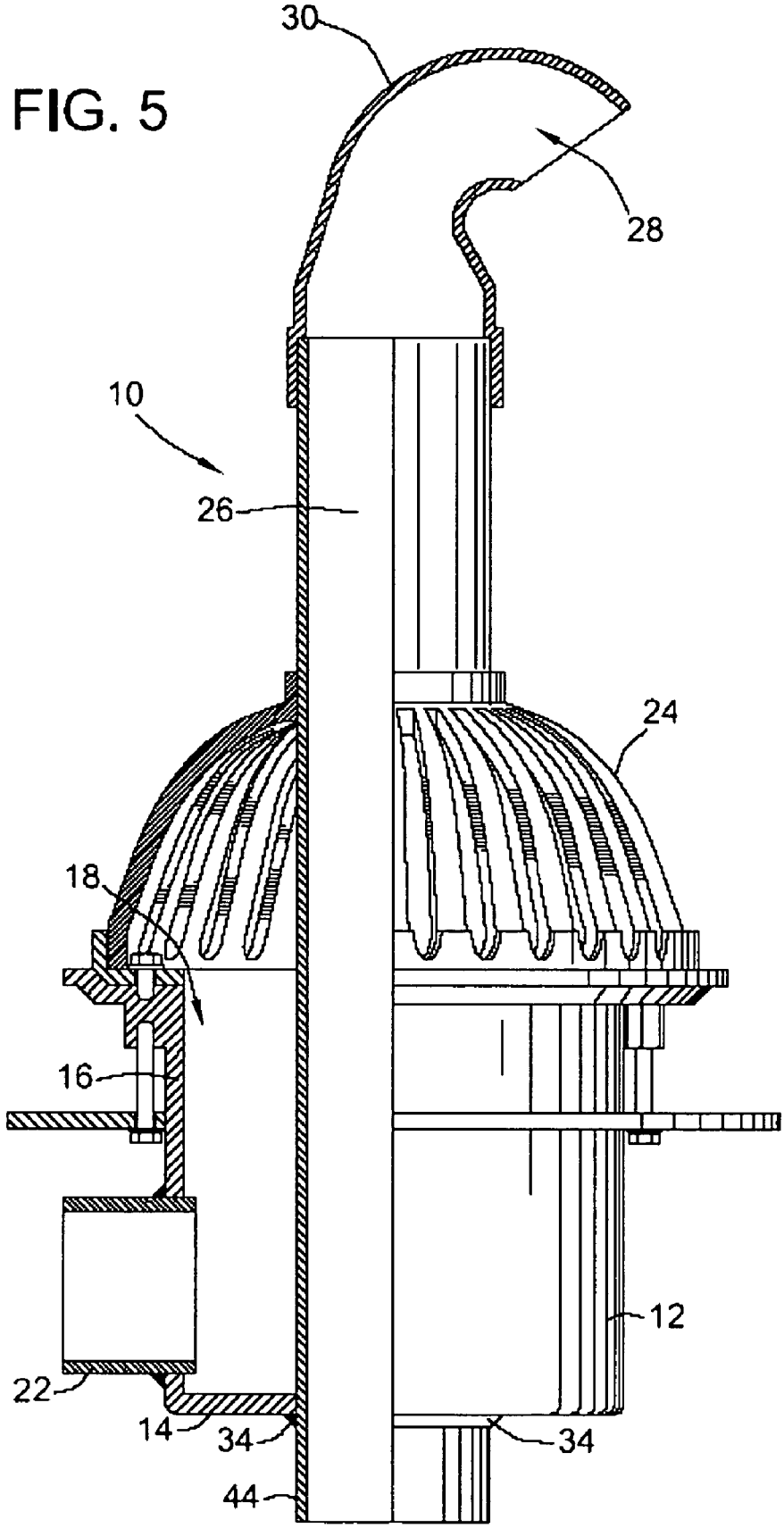
FIG. 5 is a partial cut-away side elevation view of an embodiment of a bi-functional roof drain employing a weld to provide sealing engagement.

As best shown in FIGS. 2 and 4, the vent pipe 26 terminates proximate the bottom wall 14 of the drain housing 12 and is adapted to couple with a vent system of the building. In this embodiment, the sealing engagement between the bottom wall 14 and the vent pipe 26 may be provided through the application of an appropriate sealant 32 to prevent any leaks between the bottom wall and the vent pipe. As an alternative to the usage of a water tight sealant 32, the sealing engagement between the vent pipe and the bottom wall of the housing may be accomplished by a weld 34 as shown in FIG. 5 when, for example, the vent pipe 26 penetrates and extends past the bottom wall 14.

Figure 6:
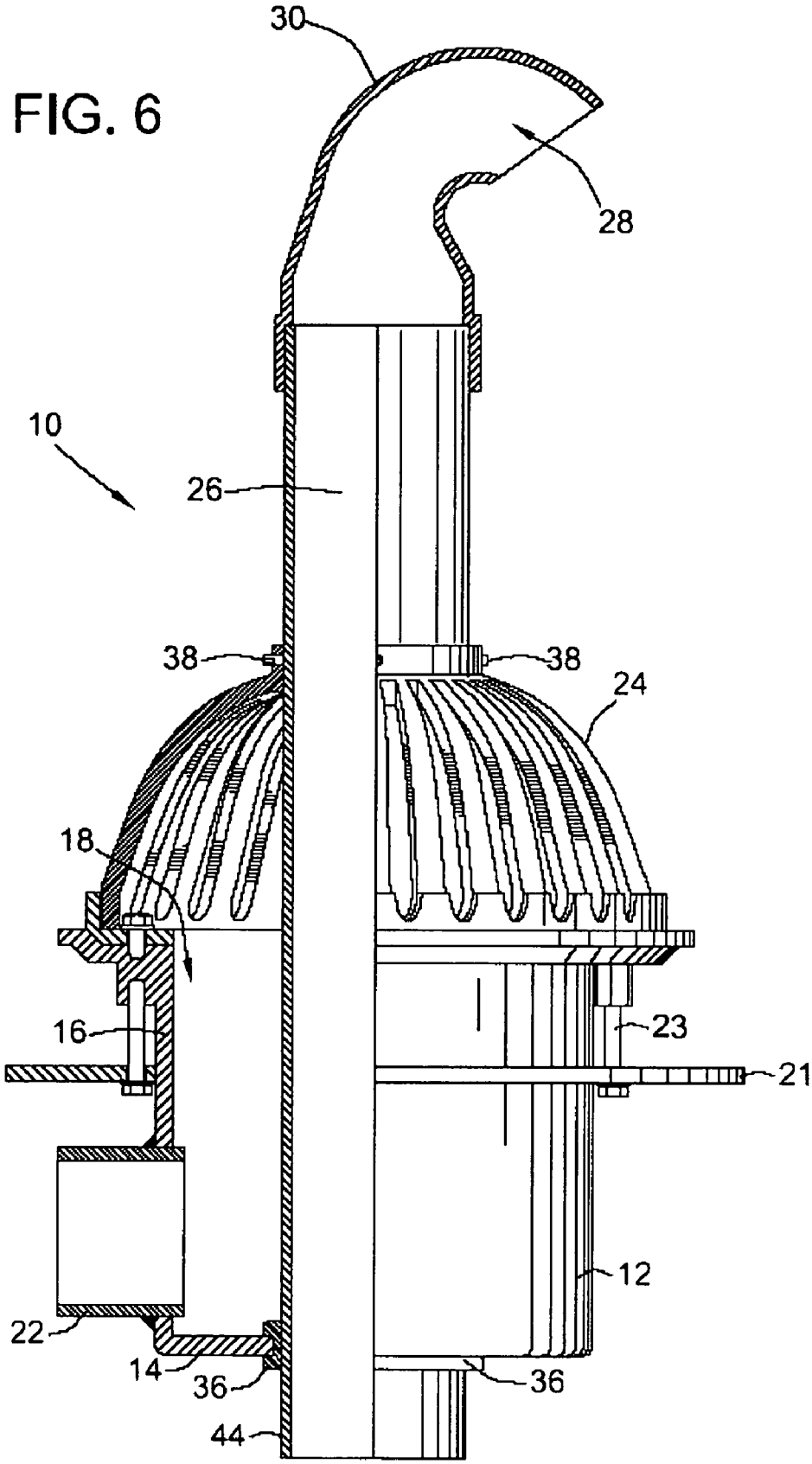
FIG. 6 is a partial cut-away side elevation view of an alternate embodiment of the bi-functional roof drain employing a gasket to provide sealing engagement and set screws to maintain a desired position of a vent pipe.

An alternate embodiment of the present invention, as depicted in FIG. 6, provides the sealing engagement through the usage of a gasket 36 positioned between the vent pipe 26 and the housing 12. By utilizing a gasket 36, the vent pipe 26 may be slidingly positioned in relation to the drain housing 12 such that the top opening 28 of the vent pipe may be varied in relation to the open top 20 of the drain housing. This sliding engagement made possible by the usage of the gasket 36 allows proper positioning of the vent pipe 26 so that the vent system is used to vent at an appropriate level.

Further, irregularities in the surface of the roof may also be taken into account to ensure that once the vent system is required, all the vent pipes 26 positioned at different locations on the roof may operate properly. This may require that roof drains 10 positioned at locations that may be slightly higher than other locations may have the vertical position of the top opening 28 of the vent pipe 26 lowered so that it is in the same horizontal plane as the top opening of the other vent pipes of other bi-functional roof drains installed at lower locations on the roof.

Once an appropriate vertical position of the top opening 28 of vent pipe 26 is determined, it may be held in place by clamping means, such as, for example, the inclusions of set screws 38 (FIG. 6) which may be tightened against the surface of vent pipe 26 to hold it in place. Other appropriate means may include the application of an adhesive, the tightening of a band, or other known means in the art. Preferably, the clamping means prevents both upward and downward dislodgement of the top opening of the vent pipe 26. However, if a clamping means is utilized that will only provide unidirectional movement prevention, it is preferred that the vent pipe 26 be secured against upward vertical dislodgement.

Figure 7:
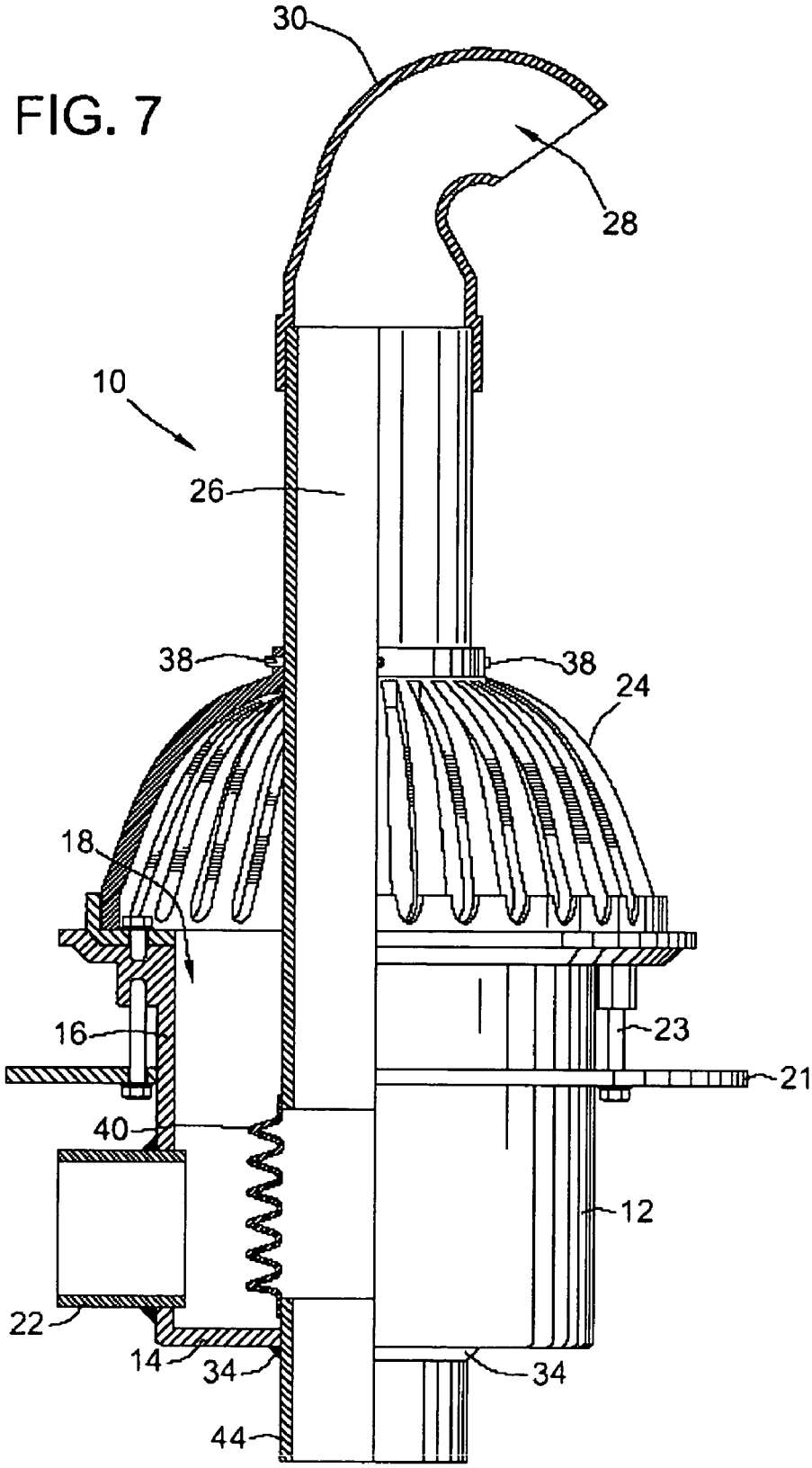
FIG. 7 is a partial cut-away side elevation view of a further alternate embodiment of the bi-functional roof drain illustrating a vent pipe with an expandable/collapsible section in a compressed position.
Figure 8:
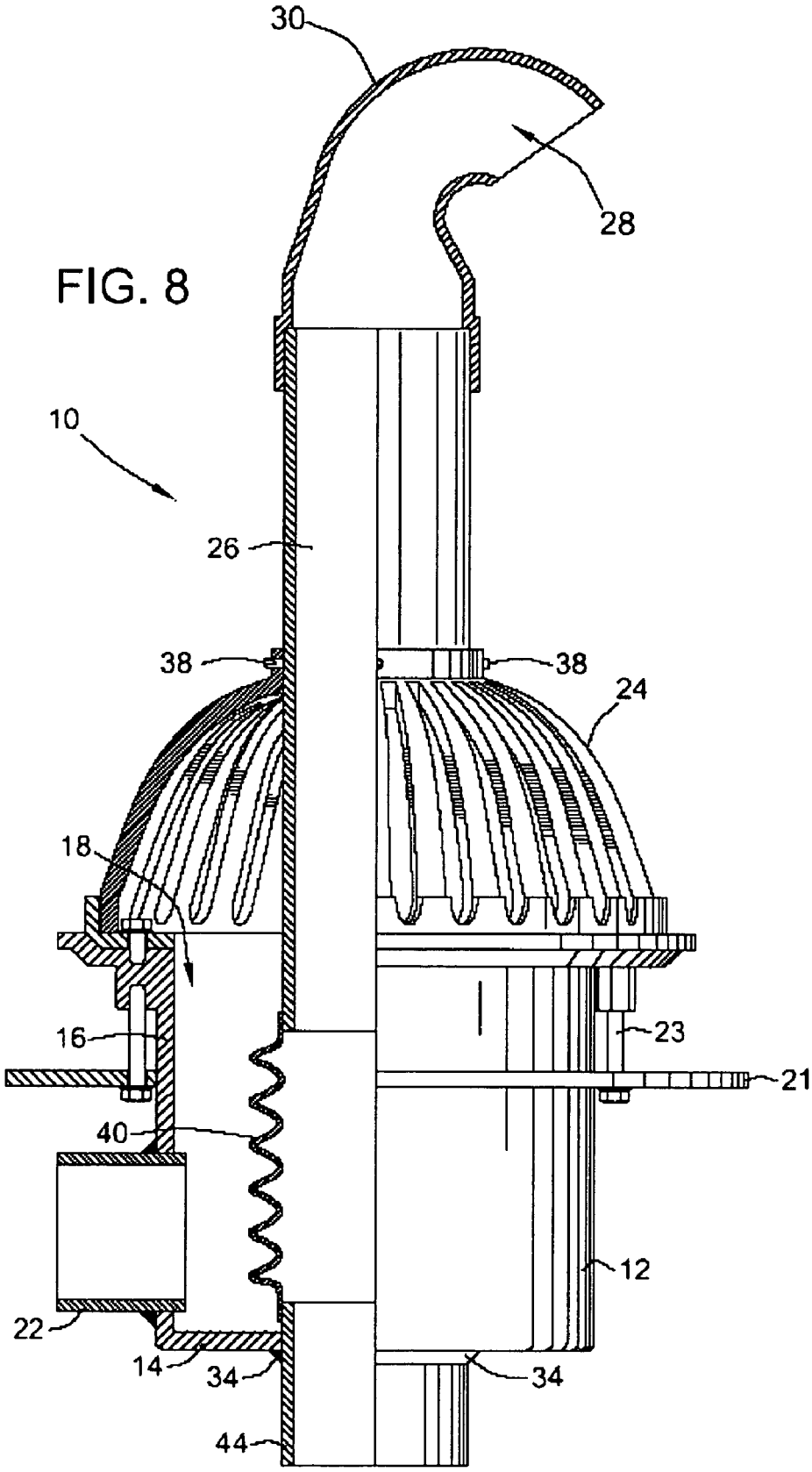
FIG. 8 is a partial cut-away side elevation view of a further alternate embodiment of the bi-functional roof drain illustrating a vent pipe with an expandable/collapsible section in an extended position.

To provide this measure of vertical height adjustability of the top opening 28 of the vent pipe 26 in embodiments of the bi-functional roof drain 10 that utilize a sealant or weld as opposed to a gasket, an extendable/collapsible section 40 may be included in the drain pipe as illustrated in FIG. 7 (compressed) and in FIG. 8 (expanded). This extendable section 40 provides for a minimum height of the top opening 28 of the vent pipe 26 when fully collapsed, and a maximum height when the section is fully extended. The vertical height of the top opening 28 of the vent pipe 26 may be adjusted anywhere between these two extremes. If additional height is necessary, an additional or longer section may be used or added to the vent pipe 26 as appropriate. When the extendable section 40 is utilized, some form of clamping means, such as set screws 38 should be utilized so that the vertical position of the top opening 28 may not be inadvertently changed as discussed above.

Figure 9:
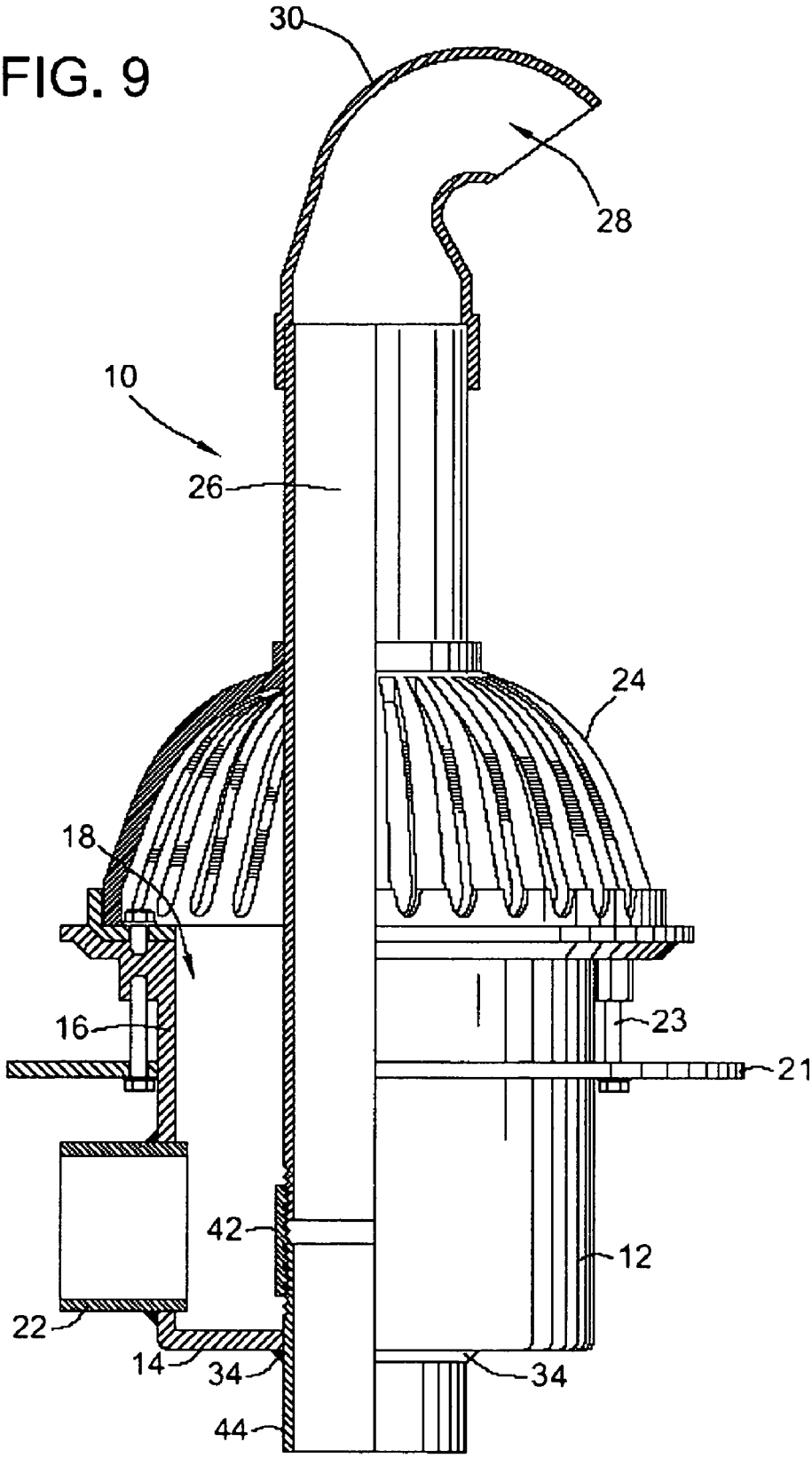
FIG. 9 is a partial cut-away side elevation view of a further additional alternate embodiment of the bi-functional roof drain incorporating a threaded fitting securing a segmented vent pipe.

Vertical height adjustability of the top opening 28 of the vent pipe 26 may also be imparted by providing a threaded fitting 42 that allows different lengths of vent pipe to be used as shown in FIG. 9. The length of the vent pipe 26 used would determine the height of the top opening 28 and can be adjusted on-site with appropriate pipe fitting tools. Alternatively, the bottom wall 14 could merely be threaded to accept vent pipes of different lengths in sealing engagement to simplify the construction.

Figure 10:
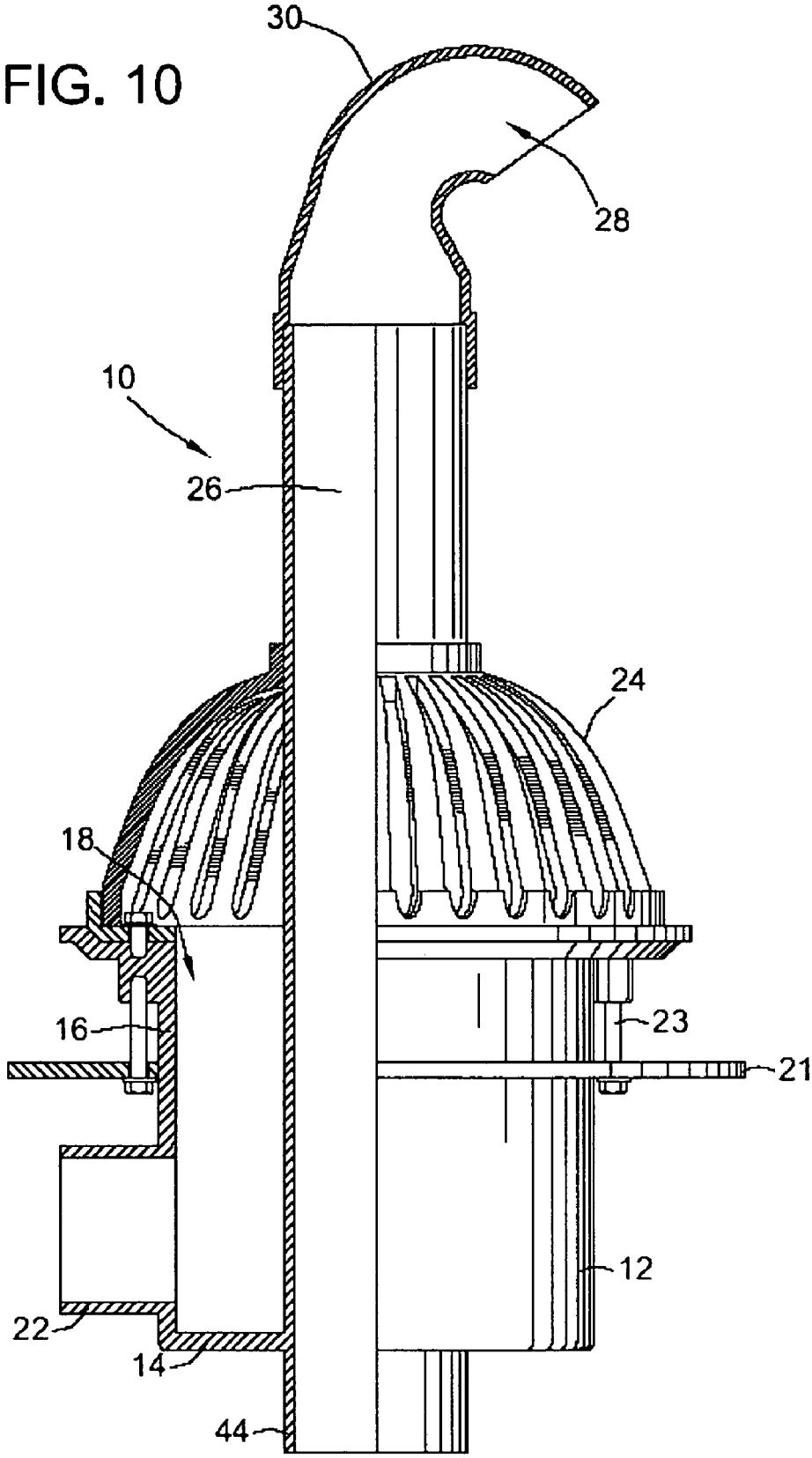
FIG. 10 is a partial cut-away side elevation view of an additional alternate embodiment of the bi-functional roof drain having a unitary construction.

An embodiment of the present invention utilizes a unitary construction of the drain housing and the vent pipe as shown in FIG. 10. A unitary construction forming the vent pipe 26, the bottom wall 14, the drain outlet 22, and the side walls 16 is illustrated. Such construction may be provided by, for example, molding the construction. Materials appropriate for drainage applications may be utilized, including PVC or other plastic, rubberized, or polymer material as appropriate for the particular application. The molding process may take into account the appropriate height of the top opening 28 of the vent pipe 26, or alternatively a standard height can be provided that may be cut to fit by the installation personnel.

Figure 11:
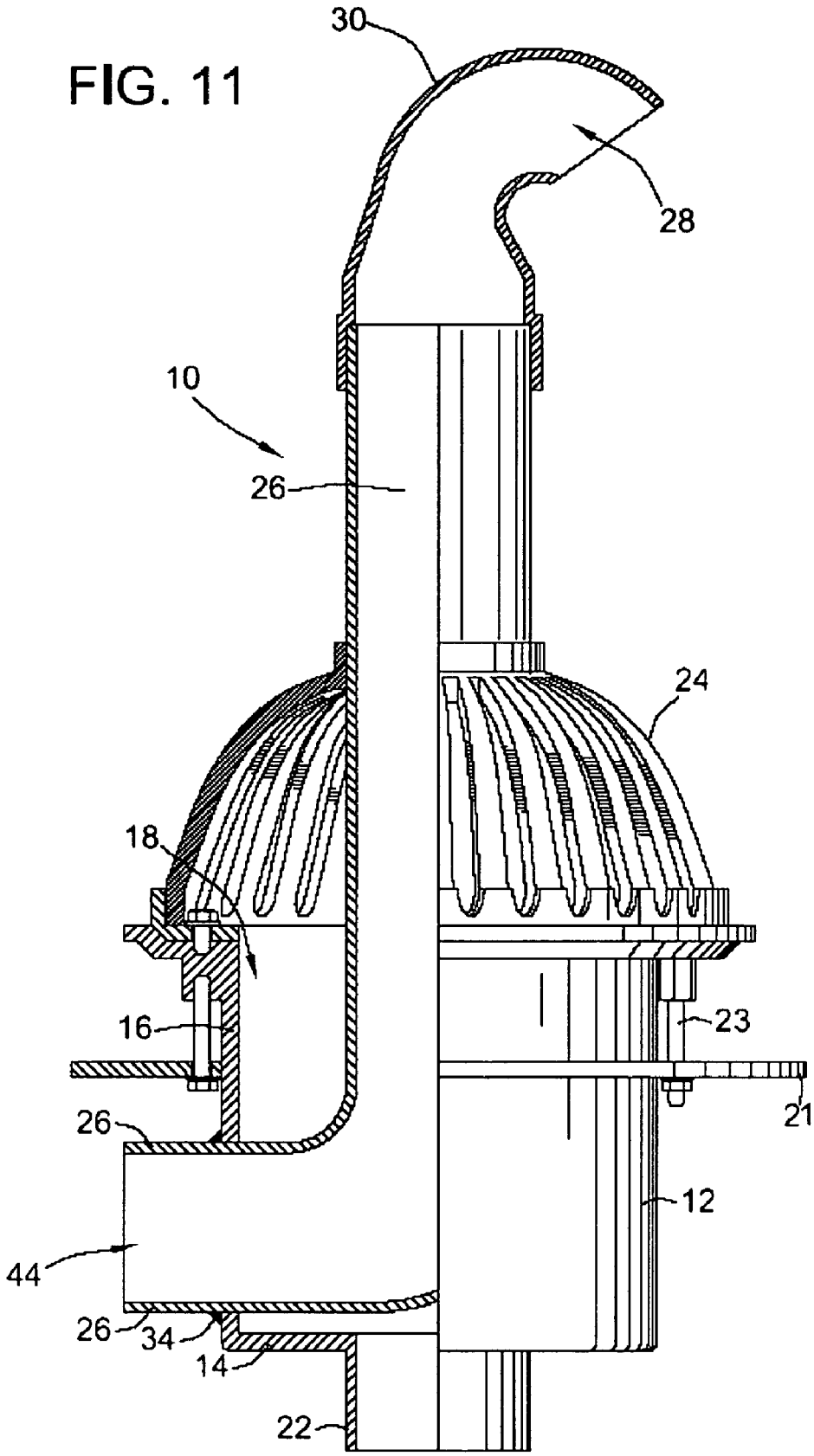
FIG. 11 is a partial cut-away side elevation view of yet an other alternate embodiment of the bi-functional roof drain constructed where the vent outlet is angled to pass through a side wall while a drain outlet is adapted to pass through a bottom wall.

In an alternate embodiment of the present invention particularly adapted to accommodate retrofitting of a uni-functional roof drain to provide both drainage of accumulated water on a roof and venting, the drain outlet 22 is located at a position that allows it to connect to the drainage system of the roof to which the uni-functional drain has previously connected as shown in FIG. 11. This is typically in the center of the drain structure. The vent pipe 26, and in particular the vent outlet 44, is relocated to a non-interfering position with the drain outlet 22. This non-interfering location can exist though the bottom wall 14 or side walls 16. This vent outlet 44 sealingly engages the side wall 16 so that it may be connected to the vent system added during the retrofit of the roof drain system of the building. In an embodiment having the non-interfering location being in the bottom wall 14, an angled or S-shaped section in the vent pipe would be used instead of the 90° section. While these embodiments are discussed as being particularly relevant to a retrofit operation, it is noted that any of the embodiments illustrated and those that come within the scope of the present invention may be used in a retrofit operation with appropriate plumbing to connect the drain outlet 22 to the drainage system and the vent outlet 44 to the vent system.

Such a retrofit operation is highly desirable as it eliminates the necessity to drill or cut additional roof deck penetrations to install the vent pipes on a building that already includes the uni-functional roof drains providing a drainage system. Additionally, the bi-functional roof drain 10 of the present invention also allows the retrofit to be accomplished without enlarging the deck penetration used by the uni-functional roof drain. The process for performing such a retrofit operation requires that the existing uni-functional roof drain be removed from the deck penetration through the roof. Once this uni-functional roof drain has been removed, a bi-functional roof drain constructed in accordance with the teachings of the present invention may then be installed through the same roof penetration. Once the roof drainage system plumbing has been installed within the building, the drain outlet 10 of the bi-functional roof drain is connected to the roof drainage system existing in the building and the vent outlet 44 of the bi-functional roof drain is connected to the system that requires venting.

As discussed above, the vertical height of the vent pipe 26 may be adjusted in relation to the surface of the roof to take into account the surface profile of the roof to ensure that proper venting occurs. This may result in the bi-functional roof drains 10 having different heights for the top opening 28 of the vent pipe 26 to properly effectuate the venting of system to which it is attached.

All of the references cited herein, including patents, patent applications, and publications, are hereby incorporated in their entireties by reference. In particular, U.S. Pat. No. 6,594,966 to Froeter is incorporated herein by this reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention when interpreted in accordance with the breadth to which they are fairly, legally, and equitably entitled.

What is claimed is:

1. A bi-functional roof drain, comprising:

a drain housing having bottom and side walls forming a drain manifold, the drain housing further including a drain outlet in communication with the drain manifold and adapted to connect to a drainage system of a building;

a strainer basket positioned over an open top of the drain housing; and a vent pipe sealingly penetrating the drain housing and extending through the drain manifold and the strainer basket, the vent pipe having a top opening positioned a vertical distance above the open top of the drain housing, the vent pipe further including a vent pipe outlet adapted to connect to a vent system of the building.

2. The bi-functional roof drain of claim 1, wherein the vent pipe penetrates the bottom wall, the drain further comprising a gasket positioned in sealing arrangement between the bottom wall and the vent pipe.

3. The bi-functional roof drain of claim 1, wherein the vent pipe translatably extends through the drain manifold such that the vertical distance from the open top of the drain housing to the top opening of the vent pipe is variable.

4. The bi-functional roof drain of claim 3, wherein the strainer basket includes clamping means positioned to securely retain the vent pipe at a given vertical position.

5. The bi-functional roof drain of claim 3, wherein the vent pipe translatably penetrates the bottom wall, the drain further comprising a gasket positioned in sealing arrangement between the bottom wall and the vent pipe.

6. The bi-functional roof drain of claim 3, wherein the vent pipe includes an extendable section within the drain manifold to accommodate variation of the vertical distance from the open top of the drain housing to the top opening of the vent pipe.

7. The bi-functional roof drain of claim 1, wherein the drain housing and the vent pipe are formed as a unitary structure.

8. The bi-functional roof drain of claim 1, wherein the vent pipe includes a plurality of openings positioned in proximity to the top opening.

9. The bi-functional roof drain of claim 8, further comprising a cap positioned over the top opening of the vent pipe.

10. The bi-functional roof drain of claim 1, wherein the drain outlet and the vent outlet are positioned to accommodate retrofitting of a uni-functional roof drain to provide drainage of accumulated water on a roof and venting of a gas within the building.

11. A bi-functional roof drain, comprising:

a drain housing forming a drain manifold therein having an open top;

a drain outlet in communication with the drain manifold; and a vent pipe extending through and isolated from communication with the drain manifold, the vent pipe having a top opening positioned a vertical distance above the open top of the drain housing, the vent pipe further including a vent outlet.

12. The bi-functional roof drain of claim 11, further comprising a strainer basket positioned over the open top.

13. The bi-functional roof drain of claim 12, wherein the drain pipe extends through the strainer basket.

14. The bi-functional roof drain of claim 11, wherein the drain housing, the drain outlet and the vent pipe are formed as a unitary structure.

15. The bi-functional roof drain of claim 14, wherein the unitary structure is molded.

16. The bi-functional roof drain of claim 11, wherein a distance between the top opening of the vent pipe and the open top of the drain housing is adjustable.

17. A method of retrofitting a roof drainage system to provide water drainage and venting, the method comprising the steps of:

removing an existing uni-functional roof drain from a deck penetration through a roof;

installing a bi-functional roof drain in the deck penetration;

installing a vent system;

connecting a drain outlet of the bi-functional roof drain to the roof drainage system; and connecting a vent outlet of the bi-functional roof drain to the vent system.

18. A method of retrofitting a roof drainage system to provide water drainage and venting, the method comprising the steps of:

removing an existing uni-functional roof drain from a deck penetration through a roof;

installing a bi-functional roof drain in the deck penetration; and adjusting a vertical height of a top opening of a vent pipe of the bi-functional roof drain in relation to a surface of the roof.

19. The method of claim 18, wherein the method further comprises the step of connecting at least one of a drain outlet of the bi-functional roof drain to a roof drainage system and connecting a vent outlet of the bi-functional roof drain to a vent system.

20. The method of claim 18, wherein the method further comprises the step of simultaneously draining water from the roof and venting a gas from within a building with the bi-directional roof drain.

* * * * *